US008839872B2

(12) United States Patent
Purkis

(10) Patent No.: US 8,839,872 B2
(45) Date of Patent: Sep. 23, 2014

(54) TREE PLUG

(75) Inventor: Daniel Purkis, Aberdeen (GB)

(73) Assignee: Petrowell Limited, Aberdeen (GB)

( * ) Notice: Subject to any disclaimer, the term of this patent is extended or adjusted under 35 U.S.C. 154(b) by 1244 days.

(21) Appl. No.: 12/514,488

(22) PCT Filed: Nov. 19, 2007

(86) PCT No.: PCT/GB2007/004372
§ 371 (c)(1),
(2), (4) Date: Feb. 10, 2010

(87) PCT Pub. No.: WO2008/059260
PCT Pub. Date: May 22, 2008

(65) Prior Publication Data

US 2010/0170681 A1 Jul. 8, 2010

(30) Foreign Application Priority Data

Nov. 17, 2006 (GB) ..... 0622916.5

(51) Int. Cl.
*E21B 33/12* (2006.01)
*E21B 23/02* (2006.01)
*E21B 33/035* (2006.01)

(52) U.S. Cl.
CPC ..... *E21B 33/035* (2013.01); *E21B 23/02* (2013.01)
USPC ..... 166/386; 166/179; 166/123; 166/182; 166/192

(58) Field of Classification Search
CPC ..... E21B 23/02; E21B 33/035
USPC ..... 166/386, 197, 123, 182, 192
See application file for complete search history.

(56) References Cited

U.S. PATENT DOCUMENTS

| | | | |
|---|---|---|---|
| 643,358 | A | 2/1900 | Konold |
| 2,009,322 | A | 7/1935 | Emil |
| 2,181,748 | A | 11/1939 | Thaheld |
| 2,230,447 | A | 2/1941 | Bassinger |
| 2,498,791 | A | 2/1950 | Clark |
| 2,546,377 | A | 3/1951 | Turechek |
| 2,738,018 | A | 3/1956 | Lynes |
| 2,832,418 | A | 4/1958 | Baker |
| 3,066,738 | A | 12/1962 | Myers |
| 3,087,552 | A | 4/1963 | Graham |

(Continued)

FOREIGN PATENT DOCUMENTS

| | | |
|---|---|---|
| DE | 3812211 | 11/1989 |
| DE | 19827708 | 1/1999 |

(Continued)

OTHER PUBLICATIONS

Pct-gb2005-001391, Int'l Prelim. Report on Patentability, Jun. 23, 2005.

(Continued)

*Primary Examiner* — Yong-Suk (Philip) Ro
(74) *Attorney, Agent, or Firm* — Wong, Cabello, Lutsch, Rutherford & Brucculeri LLP

(57) ABSTRACT

A plug for sealing a conduit. The plug comprises a housing, a setting member, at least one anchor and at least one seal element. Rotation of the setting member with respect to the housing in a setting direction sets the at least one anchor and the at least one seal element.

62 Claims, 15 Drawing Sheets

(56) References Cited

U.S. PATENT DOCUMENTS

| | | | | |
|---|---|---|---|---|
| 3,167,127 | A | 1/1965 | Sizer | |
| 3,167,128 | A | 1/1965 | Sutliff | |
| 3,283,821 | A * | 11/1966 | Brown | 166/134 |
| 3,342,268 | A | 9/1967 | Brown | |
| 3,371,716 | A | 3/1968 | Current | |
| 3,482,889 | A | 12/1969 | Cochran | |
| 3,623,551 | A | 11/1971 | Randermann | |
| 3,722,588 | A | 3/1973 | Tamplen | |
| 3,729,170 | A | 4/1973 | Lewis | |
| 3,889,750 | A | 6/1975 | Mullins | |
| 4,046,405 | A | 9/1977 | Bonds | |
| 4,127,168 | A | 11/1978 | Hanson | |
| 4,317,485 | A | 3/1982 | Ross | |
| 4,331,315 | A | 5/1982 | Geisow | |
| 4,346,919 | A | 8/1982 | Morrill | |
| 4,375,240 | A | 3/1983 | Baugh | |
| 4,588,030 | A | 5/1986 | Blizzard | |
| 4,917,187 | A | 4/1990 | Burns | |
| 5,058,684 | A | 10/1991 | Winslow | |
| 5,095,978 | A | 3/1992 | Akkerman | |
| 5,261,488 | A | 11/1993 | Gullet | |
| 5,542,473 | A | 8/1996 | Pringle | |
| 6,062,307 | A | 5/2000 | Hamid | |
| 6,315,041 | B1 | 11/2001 | Carlisle | |
| 7,690,424 | B2 | 4/2010 | McLeod | |
| 2003/0000607 | A1 | 1/2003 | Jenner | |
| 2004/0055757 | A1 | 3/2004 | Beall | |
| 2005/0224227 | A1 | 10/2005 | Hendrie | |
| 2009/0308592 | A1 | 12/2009 | Mercer | |

FOREIGN PATENT DOCUMENTS

| | | |
|---|---|---|
| EP | 0468668 | 1/1992 |
| EP | 0485080 | 5/1992 |
| EP | 1408195 | 4/2004 |
| GB | 755082 | 8/1956 |
| GB | 1257790 | 12/1971 |
| GB | 1364054 | 8/1974 |
| GB | 2118659 | 11/1983 |
| GB | 2224526 | 5/1990 |
| GB | 2245624 | 8/1992 |
| GB | 2307499 | 5/1997 |
| GB | 2328230 | 2/1999 |
| GB | WO2006046075 | 5/2006 |
| GB | 2428708 | 2/2007 |
| WO | WO02/42672 | 5/2002 |
| WO | WO 2005/026494 | 3/2005 |
| WO | WO2005/121498 | 12/2005 |
| WO | WO 2007/109878 | 10/2007 |

OTHER PUBLICATIONS

Pct-gb2005-001391, International Search Report, Jun. 23, 2005.
Pct-gb2005-001391, Written Opinion, Jun. 23, 2005.
Pct-gb2005-004200, Written Opinion, Apr. 10, 2006.
Pct-gb2005-004200, Int'l Prelim. Report on Patentability, May 1, 2007.
Pct-gb2005-004200, International Search Report, Jan. 11, 2006.
Pct-gb2005-003871 Int'l Prelim. Report on Patentability, Sep. 11, 2007.
Pct-gb2005-003871, International Search Report, Nov. 17, 2005.
Office Action dated Mar. 30, 2009, Applicant's co-pending U.S. Appl. No. 11/816,421.
Office Action dated Sep. 28, 2009, Applicant's co-pending U.S. Appl. No. 11/816,421, Sep. 28, 2009.
Foreign (UK) Office Action dated Nov. 1, 2005.
Pct-gb2005-003871, Written Opinion, Nov. 22, 2005.
Pctgb2006001297, Int'l Prelim. Report on Patentability and Written Opinion, Oct. 9, 2007.
Pctgb2006001297, International Search Report, Oct. 9, 2007.
Office Action dated May 29, 2009, Applicant's co-pending U.S. Appl. No. 11/909,820.
Office Action dated Feb. 17, 2010, Applicant's co-pending U.S. Appl. No. 11/909,820.
Pctgb2007001040, International Search Report, Jun. 5, 2010.
Pctgb2007001040, Int'l Prelim. Report on Patentability and Written Opinion, Sep. 23, 2008.
Pctgb2007004372, Int'l Prelim. Report on Patentability and Written Opinion, May 19, 2009.
Pctgb2008002042, Int'l Prelim. Report on Patentability and Written Opinion, Dec. 20, 2009.
pctgb2008002042, International Search Report, Oct. 17, 2008.
Pctgb2009071874, Int'l Prelim. Report on Patentability and Written Opinion, Jun. 8, 2010.
Pctgb2009071874, International Search Report, Jul. 23, 2009.
Pct-gb2008003883, Int'l Prelim. Report on Patentability and Written Opinion, May 25, 2010.
Pctgb2008003883, International Search Report, Mar. 26, 2009.
PCTGB200900048300, Int'l Prelim. Report on Patentability and Written Opinion, Aug. 24, 2010.
PCTGB200900048300, International Search Report, Sep. 28, 2009.
Office Action dated Aug. 25, 2010, Applicant's co-pending U.S. Appl. No. 11/577,866.
Office Action dated Oct. 7, 2010, Applicant's co-pending U.S. Appl. No. 11/909,820.
Pursuant to MPEP § 2001.6(b) applicants bring the following co-pending or issued applications to the Examiner's attention: U.S. Appl. No. 12/866,495, U.S. Appl. No. 12/743,397, U.S. Appl. No. 12/743,505, U.S. Appl. No. 12/665,641, U.S. Appl. No. 12/294,078, U.S. Appl. No. 11/909,820, U.S. Appl. No. 11/816,421, U.S. Appl. No. 11/577,866, U.S. Appl. No. 11/570,335, U.S. Appl. No. 12/743,397, U.S. Appl. No. 12/866,495, U.S. Appl. No. 12/933 053, and U.S. Appl. No. 12/933,015.
International Search Report to PCT/GB2007/004372.
International Search Report for PCT/GB2009/000730, Sep. 24, 2009.
Written Opinion for PCT/GB2009/000730, Sep. 18, 2010.
International Search Report for PCT/GB2009/000770, Oct. 8, 2009.
Written Opinion for PCT/GB2009/000770, Sep. 29, 2010.
Examination Report issued in European Application No. 08851761.0, dated Jun. 11, 2012.
Examination Report issued in Great Britain Application No. 0907391.7, dated Jul. 14, 2011.

* cited by examiner

TREE PLUG

FIELD OF THE INVENTION

The present invention relates to plugs, particularly to plugs for sealing wellbores and Christmas trees.

BACKGROUND OF THE INVENTION

Conventionally wellbores, and Christmas trees associated with wellbores, have been sealed with plugs having three basic parts: an anchoring system, a sealing element and a setting system.

The first stage in setting a conventional plug is anchoring the plug in the wellbore. Anchoring systems for conventional wellhead plugs use a set of locking dogs, which engage a recessed profile in the wellbore or tree, or use a set of slips which "bite" the casing to hold the plug in place.

The seal is then set using a linear action setting mechanism to create a linear displacement to deform the seal element. The force required to create the seal is then locked in using a linear locking mechanism. In safety critical wellbore applications, for example sub sea trees, the seal is generally a metal-to-metal seal formed by swaging a metal ring element into the bore or onto a no-go shoulder.

To provide a seal capable of withstanding well pressures, the required setting force needs to be as high as the maximum force generated by the well pressure.

In recent years a number of high pressure, high temperature, high flow rate wells have been completed which have highlighted shortcomings in conventional designs of well bore plugs and tree plugs. For example, swaged seals can dislodge when exposed to the high pressure, temperature and vibration cycles of these wells, and the jarring action used to set the seal can damage the plug or the surrounding environment.

Additionally, linear locking mechanisms have a degree of backlash which in a high temperature, pressure and vibration cycle environment can lead to failure.

A further disadvantage of conventional plugs is that the expansion achievable from the metal seal element is not sufficient to permit the plug to be run into the wellbore with adequate clearance between the plug and the wellbore to prevent a build-up of pressure in front of the plug, resisting the placement of the plug. This can be a particular problem when a number of plugs are to be located in series in a conduit, as a hydraulic lock can be formed between plugs.

It is an object of the present invention to obviate or mitigate at least one of the aforementioned disadvantages.

SUMMARY OF THE INVENTION

According to a first aspect of the present invention there is provided a plug for sealing a conduit, the plug comprising:

a housing;

a setting member;

at least one anchor; and at least one seal element;

wherein rotation of the setting member with respect to the housing in a setting direction sets the at least one anchor and the at least one seal element.

Providing a plug for sealing a conduit which requires only rotational force to be applied to set the plug reduces the amount of linear backlash present in the system and eliminates the need for a jarring action to set the seal.

Preferably, rotation of the setting member with respect to the housing in a release direction, opposite the setting direction, releases the at least one anchor and the at least one seal element. Similarly providing a plug which requires only rotational force to release the plug eliminates the need for a jarring action to release the seal.

Preferably, the plug further comprises a seal activation member.

Preferably, the setting member and the seal activation member are coupled together.

Preferably, the setting member and the seal activation member are releasably coupled together.

Preferably, the setting member and the seal activation member are coupled through a threaded connection.

Preferably, rotation of the setting member with respect to the seal activation member in the setting direction sets the at least one anchor and the at least one seal element.

Preferably, the threaded connection comprises a first threaded portion defined by the setting member and the second threaded portion defined by the seal activation member.

Preferably, the threaded connection is arranged such that a mechanical locking arrangement between the first threaded portion and the second threaded portion prevents the setting member rotating with respect to the seal activation member in the release direction. Such an arrangement prevents the plug, once set, releasing from the conduit that it is sealing.

Alternatively or additionally, the threaded connection is arranged such that friction between the first threaded portion and the second threaded portion prevents the setting member rotating with respect to the seal activation member in the release direction Preferably, rotation of the setting member with respect to the housing in the release direction requires an external force to be applied to the setting member.

Preferably, the seal activation member is prevented from rotational movement.

Preferably, the seal activation member is rotationally restrained to the housing.

Preferably, the setting member comprises a sleeve.

Preferably, the seal activation member comprises a mandrel.

Preferably, in use, the at least one anchor is set prior to the at least one seal element.

Preferably, the setting member is adapted to be connected to a setting tool.

Preferably, the setting tool is adapted to apply a rotational force to the setting member to rotate the setting member in the setting direction.

Preferably, the setting tool is adapted to apply a rotational force to the setting member to rotate the setting member in the release direction.

Preferably, initial rotation of the setting member in the setting direction causes axial movement of the setting member with respect to the housing and the seal activation member.

Preferably, axial movement of the setting member is adapted to set the at least one anchor.

Preferably, once the at least one anchor is set, further axial movement of the setting member with respect to the housing and the seal activation member is prevented.

Preferably, once the at least one anchor is set, further rotation of the setting member with respect to the housing causes axial movement of the seal activation member with respect to the housing and the setting member.

Preferably, axial movement of the seal activation member with respect to the housing and the setting member is adapted to set the at least one seal element.

Preferably, the at least one seal element is set by compression.

Preferably, the at least one seal element is compressed by being squeezed between the setting member and the housing.

In one embodiment, the at least one seal element is compressed by being squeezed between the seal activation member and the housing.

Preferably, the setting member threaded portion is defined by a nut releasably connected to the setting member sleeve.

Preferably, the setting member nut is a split nut.

Preferably, the at least one seal element comprises at least one metal seal element. A metal to metal seal element is preferred as it is better suited to high temperature applications.

Alternatively, at least one seal element comprises a polymeric seal element.

Preferably, the at least one seal element comprises at least one frusto-conical washer. Frusto-conical washers provide a high degree of expansion for a relatively small applied force.

Most preferably, the at least one seal element comprises a plurality of frusto-conical washers.

In one embodiment, there are two frusto-conical washers.

Preferably, the frusto-conical washers face in opposite directions.

Preferably, the/each frusto-conical washer comprises a lip adapted to engage with a well bore.

Preferably, the lip extends axially for an outer edge of the washer.

Preferably, the at least one anchor comprises at least one dog.

Most preferably, the at least one anchor comprises a plurality of dogs.

Preferably, the plug is adapted to be retrieved by applying a releasing force to the plug.

Preferably, the plug is adapted, in use, to disengage from a tree when the releasing force exceeds a threshold value.

Preferably, when the releasing force exceeds the threshold value, the setting member sleeve moves with respect to the setting member nut.

Preferably, when the setting member sleeve moves with respect to the setting member nut, the setting member releases from the seal activation member.

In one embodiment, the plug is arranged such that the split nut is contained by the sleeve, and movement of the sleeve with respect to the nut permits the nut to separate and release from the seal activation member threaded section.

Preferably, when the setting member releases from the seal activation member a force may be applied to the seal activation member to release the at least one seal element.

Preferably, the at least one anchor and the at least one seal element are set by rotation about a longitudinal axis of the plug.

According to a second aspect of the present invention there is provided a tool for setting a plug in a conduit, the tool comprising a plug engaging device wherein rotation of the plug engaging device, in a setting direction when engaged with a plug, sets the plug in a conduit.

Preferably, the tool is adapted to transmit a pulling force to a plug.

Preferably, the tool is adapted to transmit a pushing force to a plug. In both of these cases rotation of the plug engaging device induces linear motion in the plug.

Preferably, the tool is adapted to retrieve the plug.

Preferably, the tool further comprises a tool mandrel, the tool mandrel adapted to selectively maintain the plug engaging device with a plug.

Preferably, the tool mandrel is movable with respect to the plug engaging device to permit radial movement of the plug engaging device.

Preferably, radial movement of the plug engaging device disengages, in use, the plug engaging device from a plug.

Alternatively, linear movement of the plug engaging device disengages, in use, the plug engaging device from a plug.

Preferably, the tool is arranged such that the plug engaging device, in use, only disengages from the plug if the plug is correctly set.

Preferably, the tool mandrel is rotationally movable with respect to the plug engaging device.

Most preferably the tool mandrel is both rotationally and axially movable with respect to the plug engaging device.

Preferably, the plug engaging device comprises a plurality of collet fingers.

Preferably rotation of the plug engaging device in a release direction, opposite the setting direction, when engaged with a plug, releases the plug from the conduit.

According to a third aspect of the present invention there is provided a tool for setting the plug of the first aspect.

According to a fourth aspect of the present invention there is provided a tool for retrieving the plug of the first aspect.

According to a fifth aspect of the present invention there is provided a plug and setting tool system, the system comprising:

a plug, the plug comprising a housing, a setting member, at least one anchor and at least one seal element; and a tool, the tool comprising a setting member engaging device;

wherein rotation of the setting member engaging device in a setting direction rotates the setting member with respect to the housing, rotation of said setting member setting the at least one anchor and the at least one seal element.

According to a sixth aspect of the present invention there is provided a method of setting a plug in a conduit, the method comprising the steps of:

rotating a plug setting member in a setting direction to set at least one anchor; and continuing to rotate the plug setting member in the setting direction to set at least one seal element.

Preferably, the method further comprises the step of rotating the plug setting member in a release direction opposite the setting direction to release the at least one anchor and continuing to rotate the plug setting member in the release direction to release the at least one seal element.

Preferably the method further comprises the step of applying a pulling force to the plug to retrieve the plug from the conduit.

According to a seventh aspect of the present invention there is provided a method of retrieving a plug from a conduit, the method comprising the steps of:

rotating a plug setting member in a release direction opposite a setting direction to release at least one anchor and at least one seal element from a conduit wall; and applying a pulling force to the plug to retrieve said plug from the conduit.

According to an eighth aspect of the present invention there is provided a method of retrieving a plug from a conduit, the method comprising the steps of:

applying a pulling force to the plug to disengage a plug setting member from a seal activation member;

translating the plug setting member with respect to at least one to release said at least one anchor from a conduit wall;

translating the seal activation member with respect to at least one seal element to release said at least one seal element from the conduit wall; and continuing to apply the pulling force to the plug to retrieve the plug from said conduit.

According to a ninth aspect of the present invention there is provided a method of releasing a setting tool from a plug, the method comprising the steps of:

simultaneously applying a pulling force and a rotational force to a tool mandrel such that the tool mandrel translates axially with respect to a plug setting member engaging device, the plug setting member engaging device being engaged with a plug; and permitting the plug setting member engaging device to release from the plug.

According to a tenth aspect of the present invention there is provided a method of releasing a setting tool from a plug, the method comprising the steps of:

applying a pulling force to a tool mandrel to release the tool mandrel from a plug setting member engaging device, the plug setting member engaging device being engaged with a plug;

continuing to apply the pulling force to the tool mandrel to axially translate the tool with respect to the plug setting member engaging device; and permitting the plug setting member engaging device to release from the plug.

According to an eleventh aspect of the present invention there is provided a seal element for sealing a conduit comprising:

a frusto-conical washer, the washer defining a lip extended from an external edge of the washer.

It will be understood that features described in connection with one of the aspects may be equally applied to another one of the aspects and are not repeated for brevity.

BRIEF DESCRIPTION OF THE DRAWINGS

Embodiments of the present invention will now be described with reference to the attached drawings in which.

DETAILED DESCRIPTION OF THE DRAWINGS

Figure 1A:
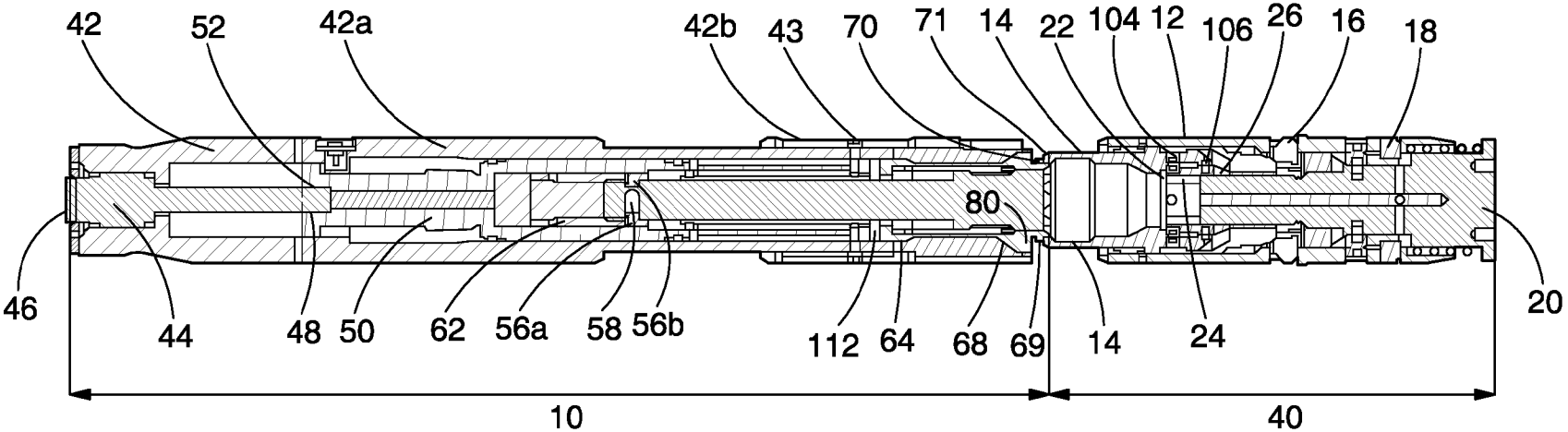
FIG. 1*a* is a longitudinal section view of a plug and a setting and retrieving tool in a pre-engaged configuration, according to an embodiment of the present invention.
Figure 1B:
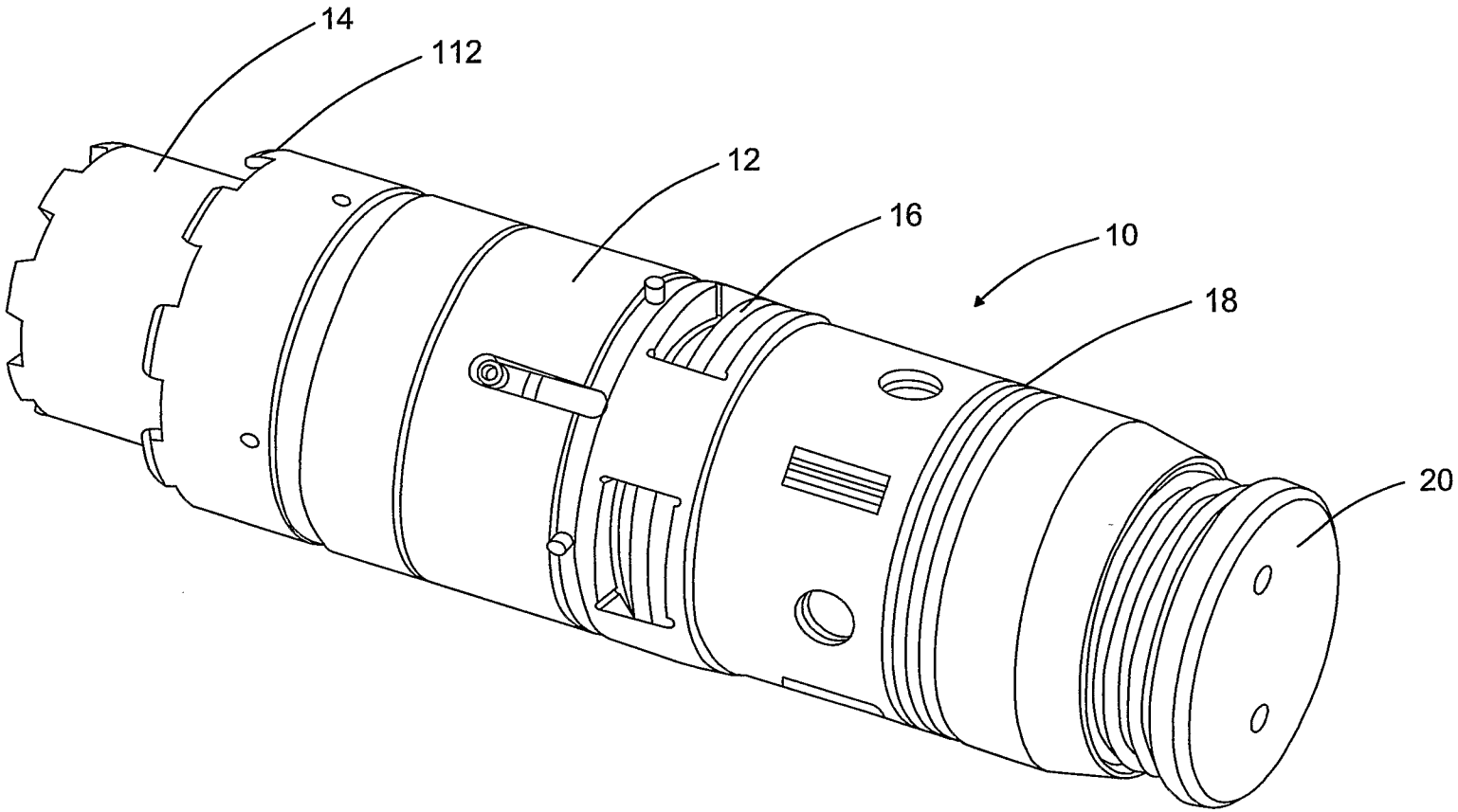
FIG. 1*b* is a perspective view of the plug of FIG. 1*a;*

Referring firstly to FIG. 1*a*, a longitudinal section view of a plug 10 and a setting and retrieving tool 40 shown in a pre-engaged configuration, according to an embodiment of the present invention, and FIG. 1*b*, a perspective view of the plug of FIG. 1*a*, the plug 10 comprises a housing 12, a setting member 14 in the form of a sleeve, a plurality of anchors in the form of six dogs 16 of which two are visible 16*a*,16*b*, a plurality of seal elements 18 in the form of a stack of frusto-conical washers, and a plug mandrel 20 for activating the seal elements 18.

Figure 1C:
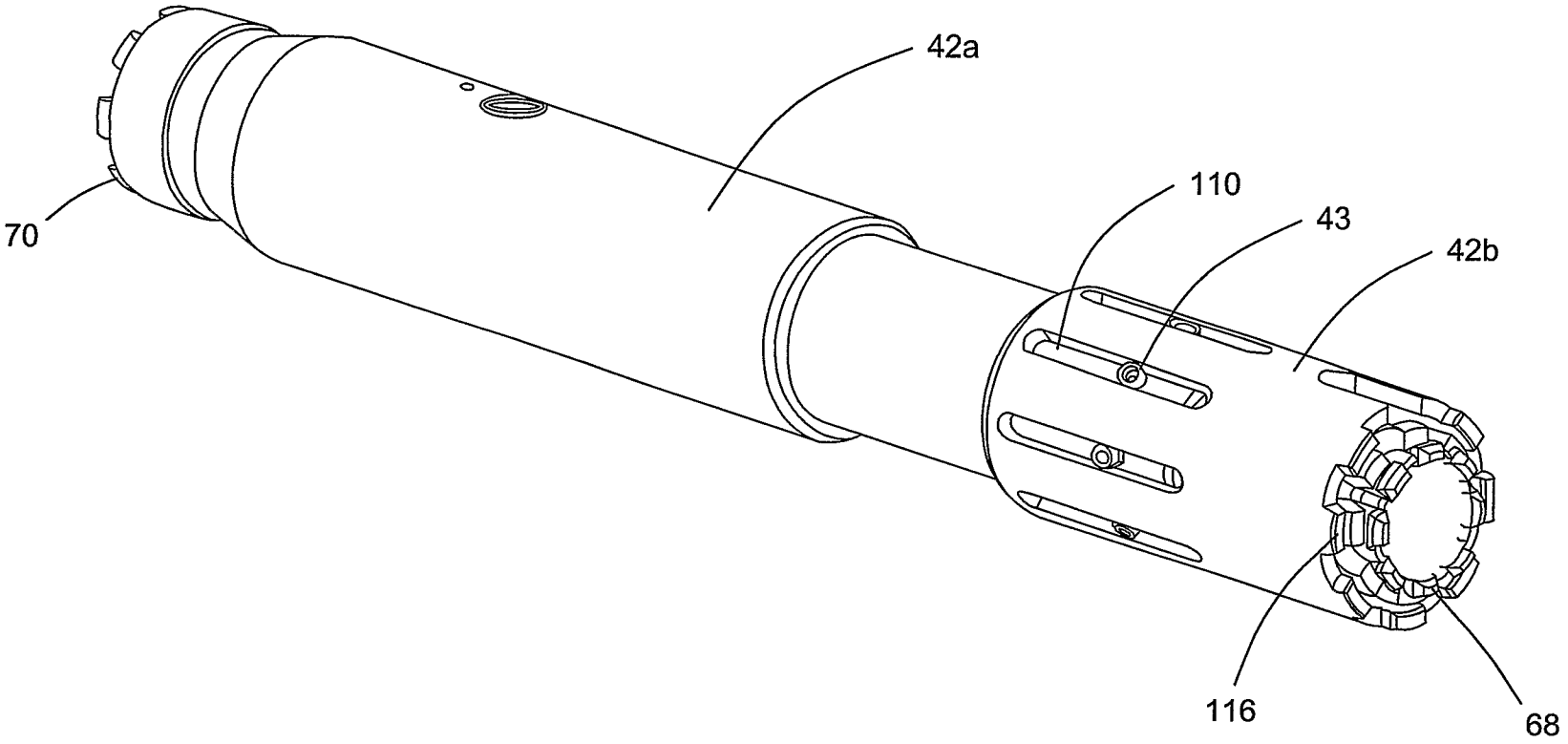
FIG. 1*c* is a perspective view of the tool of FIG. 1*a;*

Referring to FIG. 1*a* and FIG. 1*c*, a perspective view of the tool of FIG. 1*a*, the setting member sleeve 14 includes a split nut 22 defining an internal thread 24 which engages a complementary external thread 26 defined by the plug mandrel 20. The split nut 22 is attached to the main sleeve by a twelve shear pins 104,106. The purpose of these shear pins 104,106 will be discussed in due course.

The setting and retrieval tool 40 comprises a tool housing 42, a drive shaft 44 adapted to be connected at a first end 46 to a motor (not shown) and at a second end 48 to a pulling sleeve 50. The tool housing 42 comprises an upper tool housing 42*a* and a lower tool housing 42*b*. The upper tool housing 42*a* include eight tool housing pins 43, each pin slidably engaging a tool housing slot 110 defined by the lower tool housing 42*b*. This arrangement can be best seen in FIG. 1*c*.

The pulling sleeve 50 is connected to the drive shaft 44 by an axial spline 52 which rotationally fixes the pulling sleeve 50 to the drive shaft 44 but permits axial movement of between the pulling sleeve 50 and the drive shaft 44. Extending from, and fixed to, the pulling sleeve's internal surface are first and second pins 56*a*,56*b*. The pins 56*a*,56*b* moveably engage first and second slots 58 (only one is visible) defined by a tool mandrel 60. Sandwiched between the tool mandrel 60 and the pulling sleeve 50 is a gripping collar 62 and a series of collet fingers 64. The gripping collar 62 and collet fingers 64 are realisably secured by six shear screws 112. The gripping collar 62 and collet fingers 64 extend along the length of the tool mandrel 60 and, as can be seen from FIG. 1*a*, the collet fingers 64 are supported and prevented from moving radially inwards by an external surface 80 of the tool mandrel 60.

Figure 2:
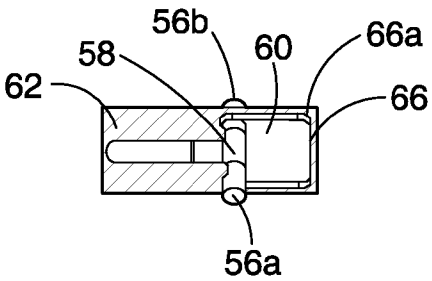
FIG. 2 is an enlarged cut-away side view of part of the tool mandrel, part of the gripping collar and the pins of the FIG. 1*a;*

As can be seen from FIG. 2, an enlarged cut-away side view of part of the tool mandrel 60, the collar 62 and the pins 56*a*,56*b* of FIG. 1*a*, each pin 56 extends from the pulley sleeve (not shown) and passes through a cut-out 66 defined by the collar 62 to engage the tool mandrel 60. Only the first cut-out 66*a* associated with the first pin 56*a* is shown in FIG. 2. The purpose of the arrangement of the pins 56, the slot 58 and the gripping collar cut-outs 66 will be discussed in due course.

Referring back to FIG. 1*a*, the tips 68 of the collet fingers 64 are shown engaged with a tapered surface 70 defined by the setting member sleeve 14. To set the plug 10 in a conduit (not shown) the tool 40 needs to engage and grip the plug 10 and applies a rotational force to the plug. This tool 40 grips the plug 10 through an external groove 69 defined by the collet fingers 64 receiving an internal lip 71 defined by the setting member sleeve 14, as will now be discussed with reference to FIGS. 3 to 8.

Figure 3:
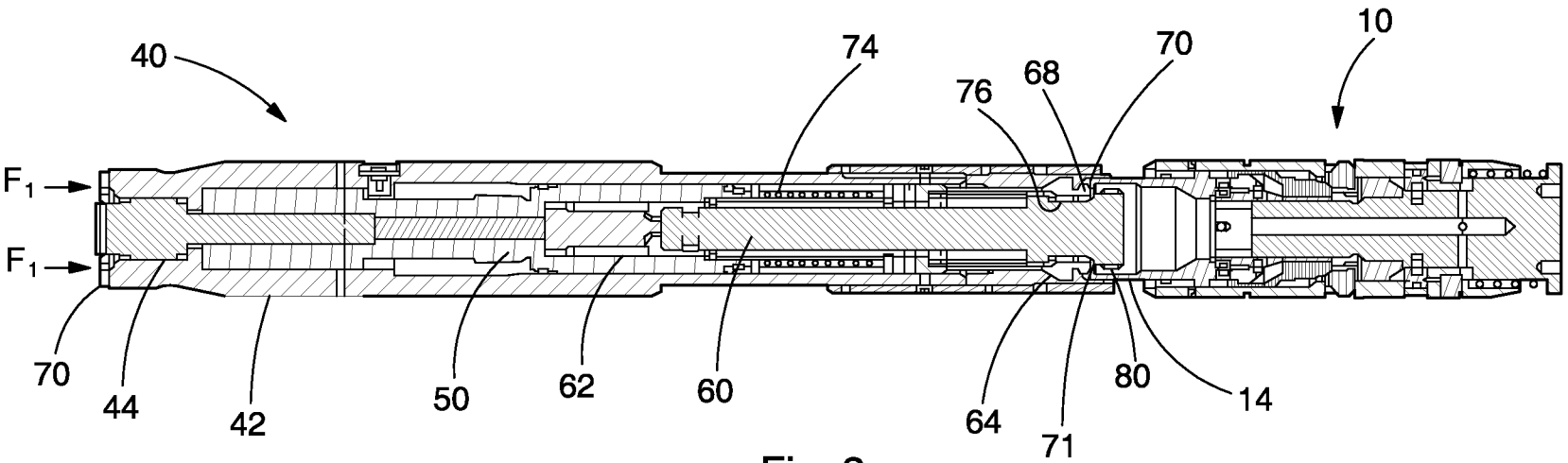
FIG. 3 is a longitudinal sectional view of the plug and tool of FIG. 1*a* in a partially engaged configuration.

Referring to FIG. 3, a longitudinal section view of the plug 10 and tool 40 of FIG. 1*a* in a partially engaged configuration, a force $F_1$ has been applied on the end 70 of the tool 40 in the direction of the plug 10. The tool housing 42, the drive shaft 44, the pulling sleeve 50 and the tool mandrel 60 all move towards the plug 10. The engagement of the collet fingers 64 with the setting member sleeve 14 prevents the gripping collar 62 moving axially with the rest of the tool 40. The gripping collar 62 remains stationary and compresses a gripping collar spring 74.

Figure 4:
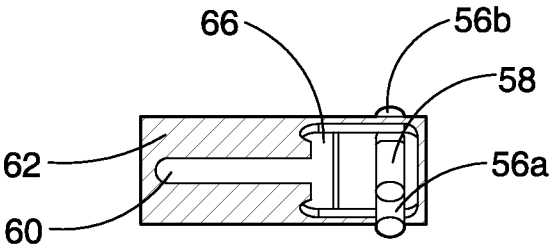
FIG. 4 is an enlarged cut-away side view of part of the tool mandrel, part of the gripping collar and the pins of FIG. 3.

Referring to FIG. 4, an enlarged cut-away side view of part of the tool mandrel 60, the collar 62 and the pins 56*a*,56*b* of FIG. 3, it can be seen that as the tool mandrel 60 moves with respect to the gripping collar 62, so the pins 56*a*,56*b* move axially within the gripping collar cut-out 66.

Figure 5:
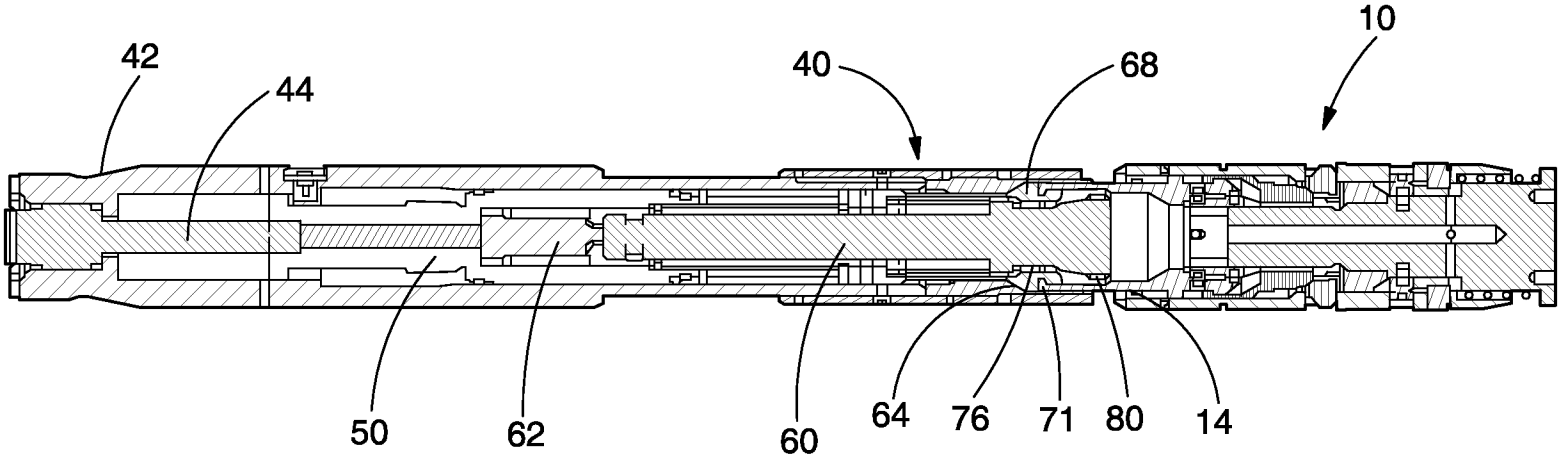
FIG. 5 is a longitudinal sectional view of the plug and tool of FIG. 1*a* in a latched configuration.
Figure 7:
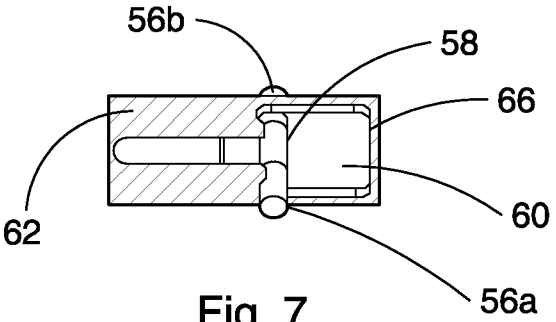
FIG. 7 is an enlarged cut-away side view of part of the tool mandrel, part of the gripping collar and the pins of FIG. 6.

As the rest of the tool 40 moves axially with respect to the gripping collar 62, the tool mandrel 60 moves inside the gripping collar 62 until a mandrel recess 76 is located behind the collet fingers 64. The interaction of the tapered surfaces 68,70 of the collet fingers 64 and the setting member sleeve 14 causes the collet finger 64 to deflect radially inward. Once deflected, the gripping collar spring 74 moves the gripping sleeve 62 axially with respect to the plug 10, permitting the collet fingers 64 to latch on to the internal lip 71 defined by the setting member sleeve 14. This position is shown in FIG. 5, a longitudinal section view of the plug 10 and tool 40 shown in a latched configuration.

Figure 6:
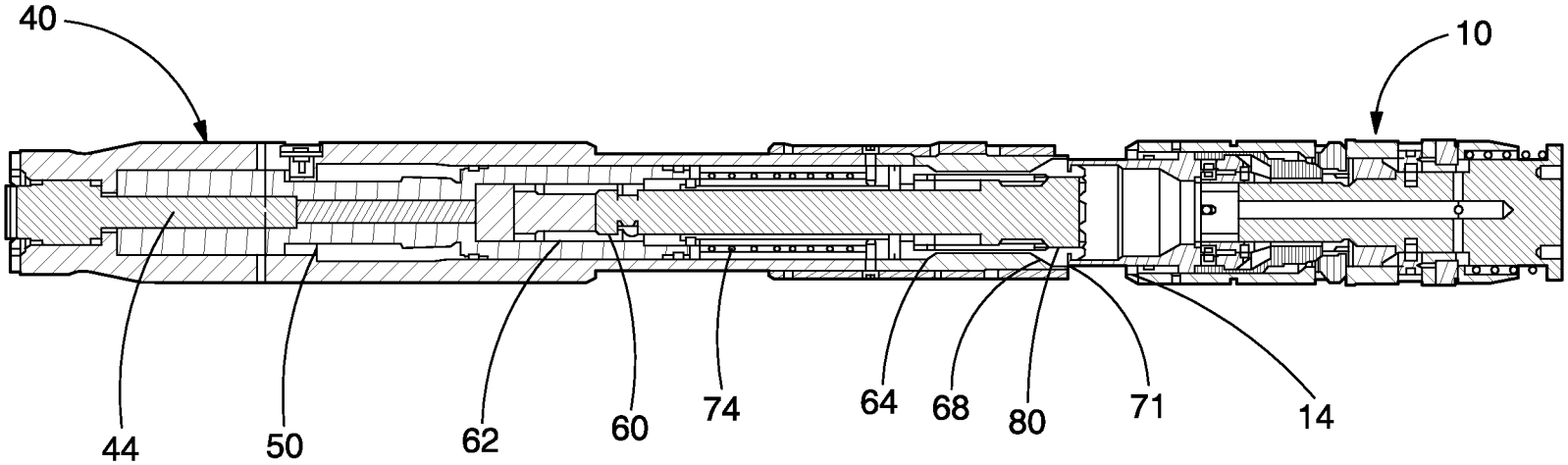
FIG. 6 is a longitudinal sectional view of the plug and tool of FIG. 1*a* in a latched and supported configuration.

Continued action of the gripping collar spring 74 moves the gripping collar 62 axially with respect to the tool mandrel 60 until the collet finger tips 68 are supported by the tool mandrel surface 80. This is shown in FIG. 6, a longitudinal section view of the plug 10 and tool 40 of FIG. 1*a* in a latched and supported configuration. In this position, as can be seen from FIG. 7, an enlarged cut-away side view of part of the tool mandrel 60, the collar 62 and the pins 56*a*,56*b* of FIG. 6, the pins 56*a*,56*b* are located in the position originally shown in FIGS. 1*a* and 2.

Figure 8:
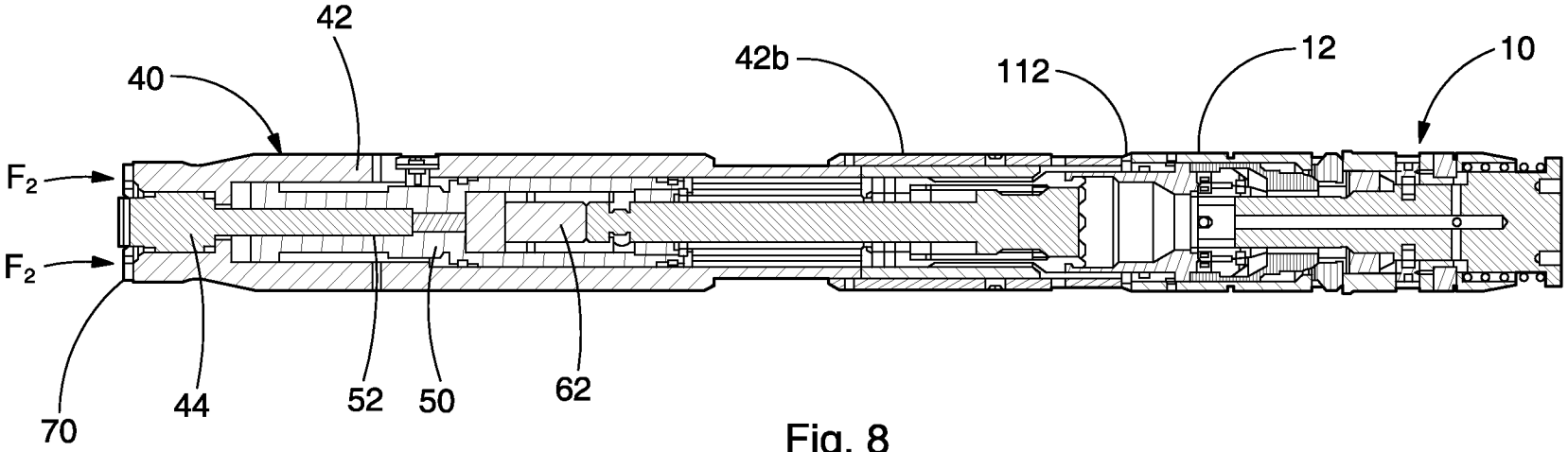
FIG. 8 is a longitudinal sectional view of the plug and tool of FIG. 1*a* with the tool and plug housings engaged.

Referring now to FIG. 8, a longitudinal section view of the plug 10 and tool 40 of FIG. 1*a* with the tool and plug housings 42,12 engaged, this Figure shows that following the application of a further longitudinal force $F_2$ to the tool-end 70, the tool housing 42 and the drive shaft 44 have moved with respect to the pulling sleeve 50, the tool mandrel 60 and the gripping collar 62 until the lower tool housing 42*b* has engaged the plug housing 12. Complementary castellations 112 on the ends of the plug housing 12 and the lower tool housing 42*b* engage ensuring the two housings 12,42 do not rotate as the plug 10 is set. The castellations 112 on the ends of the housings 12,42 are most clearly seen in FIGS. 1*b* and 1*c*.

It will be noted from FIG. 8 that the action of moving the plug housing 42 and the drive shaft 44 has caused the pulling sleeve 50 to travel along the spline 52 between the pulling sleeve 50 and the drive shaft 44.

Figure 10:
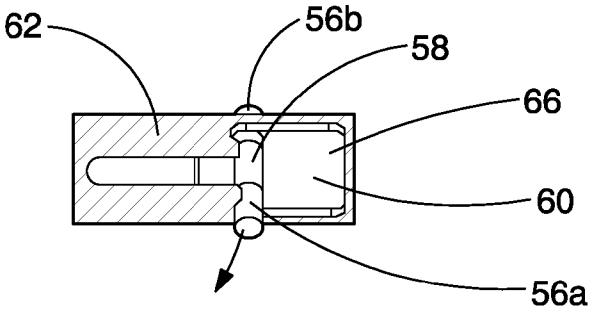
FIG. 10 is an enlarged cut-away side view of part of the tool mandrel, part of the gripping collar and the pins of FIG. 9.
Figure 9:
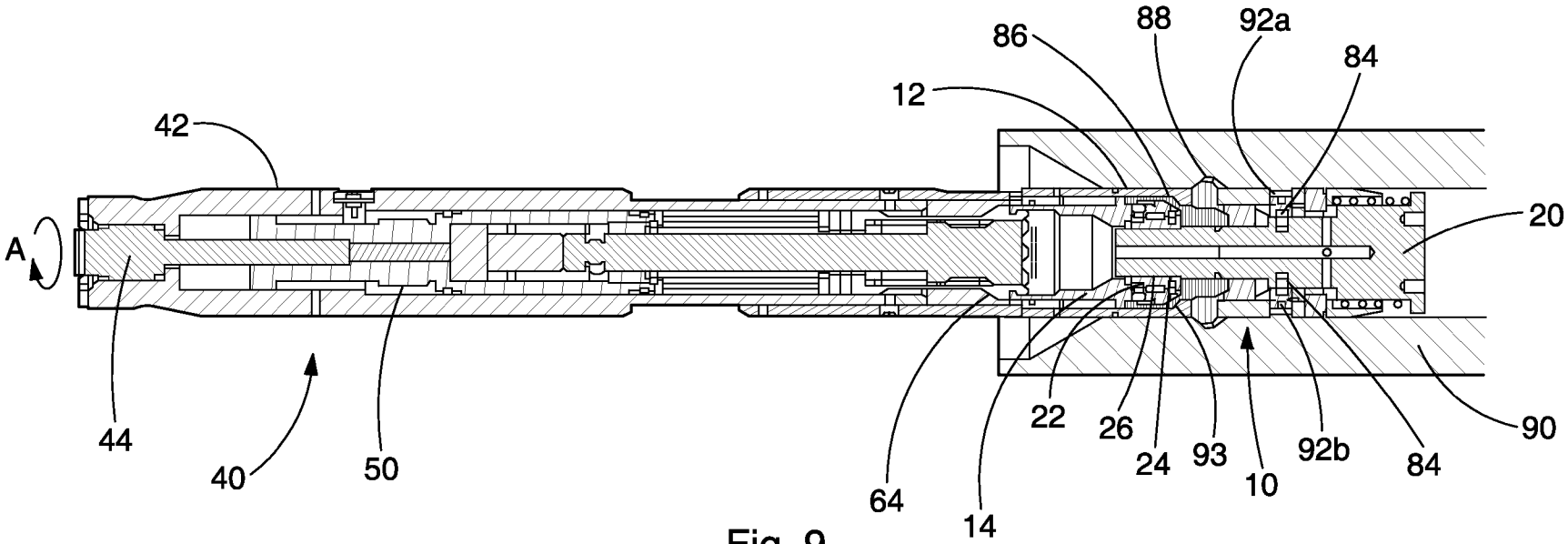
FIG. 9 is a longitudinal sectional view of the plug and tool of FIG. 1*a* showing the plug partially set.

Referring now to FIG. 9, a longitudinal section view of the plug 10 and tool 40 of FIG. 1*a* showing the plug 10 partially set. Once the housings 12,42 are engaged, the plug 10 can be set in a tree 90 by rotation of the drive shaft commences in the direction of arrow A. As previously discussed, the drive shaft 44 and the pulling sleeve 50 are rotationally fixed. As can be seen from FIG. 10, an enlarged cut-away side view of part of the tool mandrel 60, the collar 62 and the pins 56*a*,56*b* of FIG. 9, rotation in the direction of arrow A will also ensure rotation of the gripping collar 62 and the tool mandrel 60 because the pins 56*a*,56*b* are engaged with the edge of the gripping collar cut-out 66 and the pins 56 are at the extreme end of the mandrel slots 58.

Referring back to FIG. 9, as the collet fingers 64 are engaged with the plug setting sleeve 14, the setting sleeve 14 also rotates. The plug mandrel 20 is fixed with respect to the plug housing 12 by a pair of shear screws 84, attached to first and second housing lugs 92*a*,92*b*. As the plug setting sleeve 14 rotates, the interaction of the internal thread 24 of the split nut 22 and the external thread 26 of the plug mandrel 20 results in the setting sleeve 14 translating axially with respect to the plug housing 12 and the plug mandrel 20 because the plug mandrel 20 is axially fixed by the shear screws 84.

As the plug setting sleeve 14 translates towards the dogs 16, the setting sleeve 14 engages a dog setting collar 86 which, under the action of the plug setting sleeve 14, travels behind the dogs 16 forcing them radially outwards into recesses 88 defined by the wall of the tree 90.

Once the dogs 16 are fully engaged, as shown in FIG. 9, continual axial movement of the plug setting sleeve 14 with respect to the plug housing 12 is prevented by the engagement of the dog setting collar 86 with a shoulder 93 defined by the plug housing 12.

Figure 11:
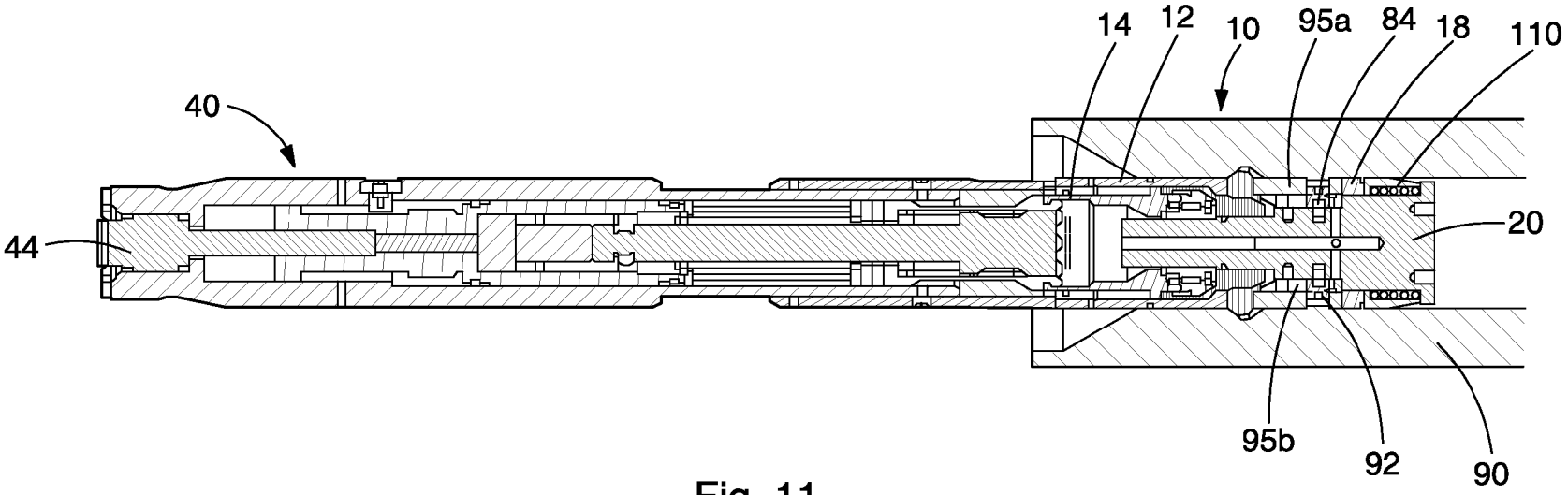
FIG. 11 is a longitudinal section view of the plug and tool of FIG. 1*a* showing the plug fully set.

As shown in FIG. 11, a longitudinal section view of the plug 10 and tool 40 of FIG. 1*a* showing the plug 10 fully set, continued rotation of the drive shaft 44 then applies a pulling force to the plug mandrel 20. Once the pulling force is of sufficient magnitude to overcome the shear screws 84, the plug mandrel 20 translates axially with respect to the setting sleeve 14 and the plug housing 12, in a direction towards the setting sleeve 14, to compress the seal elements 18 into engagement with the tree plug 90. As well as compressing the seal elements 18, a mandrel spring 110 is also compressed. The purpose of the mandrel spring 110 will be discussed in due course.

The plug mandrel 20 is prevented from rotating with the setting sleeve 14 by the housing lugs 92 which are located in first and second axial slots 95*a*,95*b* respectively slots defined by the plug mandrel 20.

The plug 10 is now fully set in the tree 90 and the rotation of the drive shaft 44 can be stopped. Friction between the split nut internal thread 24 the plug mandrel external thread 26 prevents rotation of the setting sleeve 14 with respect to the plug mandrel 20 in the reverse direction, which would reverse the setting process and release the plug from the tree 90.

If the pressure test has been successful, the tool 40 can be disengaged from the plug 10 and recovered to surface leaving the plug 10 located in the tree 90. The preferred method of recovering the tool 40 will be discussed in connection with FIGS. 12, 13*a* and 13*b*. Alternatively, if the pressure test has been a failure, a user will probably wish to recover both the tool 40 and the plug 10 to surface to assess why the plug 10 did not set correctly. The preferred method of recovering both the tool 40 and the plug 10 will be discussed in connection with FIGS. 14 and 15. This preferred method can also be used to recover a plug 10 which has been located in a tree 90 for a period of time.

Figure 13B:
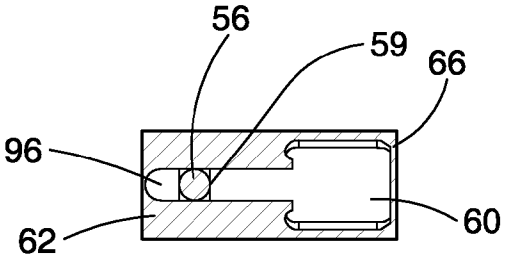
FIG. 13*b* is an enlarged cut-away side view of part of the tool mandrel, part of the gripping collar and the pins of FIG. 12.
Figure 13A:
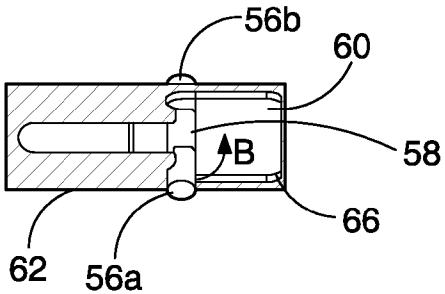
FIG. 13*a* is an enlarged cut-away side view of part of the tool mandrel, part of the gripping collar and the pins of FIG. 11.
Figure 12:
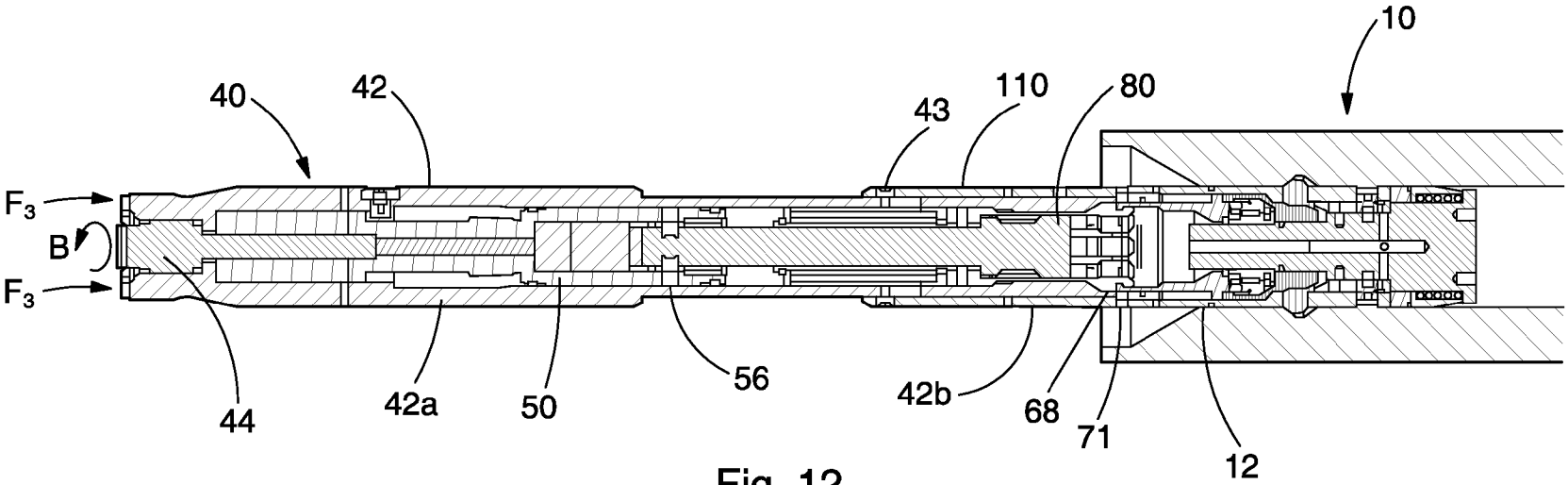
FIG. 12 is a longitudinal section view of the plug and tool of FIG. 1*a* showing the tool disengaging from the plug.

Reference is made to FIG. 12, a longitudinal section view of the plug 10 and tool 40 of FIG. 1*a* showing the tool 40 disengaging from the plug 10 and FIGS. 13*a* and 13*b*, enlarged cut-away side views of part of the tool mandrel 60, the collar 62 and the pins 56*a*,56*b*. To disengage the tool 40 from the plug 10, the drive shaft 44 is rotated in the direction of arrow B opposite to the direction arrow A. Simultaneously with the rotation being applied to the drive shaft 44, a pulling force $F_3$ is applied to the tool 40. As the drive shaft 44 rotates, the pulling mandrel 50 and the pins 56 also rotate. The pins 56 rotate with respect to the tool mandrel 60 along the mandrel slots 58 from the position shown in FIG. 13*a* to the slot midpoint 59. At this position the pins 56 are aligned with a cut-out slot 96 defined by the gripping collar 62. The pulling force $F_3$ applied to the tool 40 causes the pins 56 to translate along the slot 96, permitting the upper tool housing 42*a*, the drive shaft 44, the pulling sleeve 50 and the tool mandrel 60 to translate axially away from the plug 10. FIG. 13*b* shows the pins 56 translated along the slot 96.

The lower tool housing 42*b* remains engaged with the plug housing 12 to ensure the tool housing 42 does not rotate with the drive shaft 44. As the upper tool housing 42*a* is pulled away from the plug 10 the tool housing pins 43 slide in the slots 110 (see FIG. 1*c*) defined by the lower tool housing 42*b*, permitting axial movement of the upper tool housing 42*a* with respect to the lower tool housing 42*b*.

As can be seen from FIG. 12, in this position the mandrel-defined support surface 80 has translated away from behind the collet finger tips 68 permitting the collet finger tips 68 to disengage from the setting sleeve internal lip 71 under the force $F_3$, disengaging the tool 40 from the plug 10. As the tool 40 is pulled away from the plug 10 the lower tool housing 42*b* disengages from the plug 10. The tool 40 can then be retrieved to surface.

Figure 15:
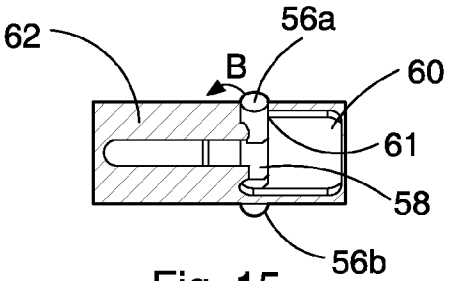
FIG. 15 is an enlarged cut-away side view of part of the tool mandrel, part of the gripping collar and the pins of FIG. 14.
Figure 14:
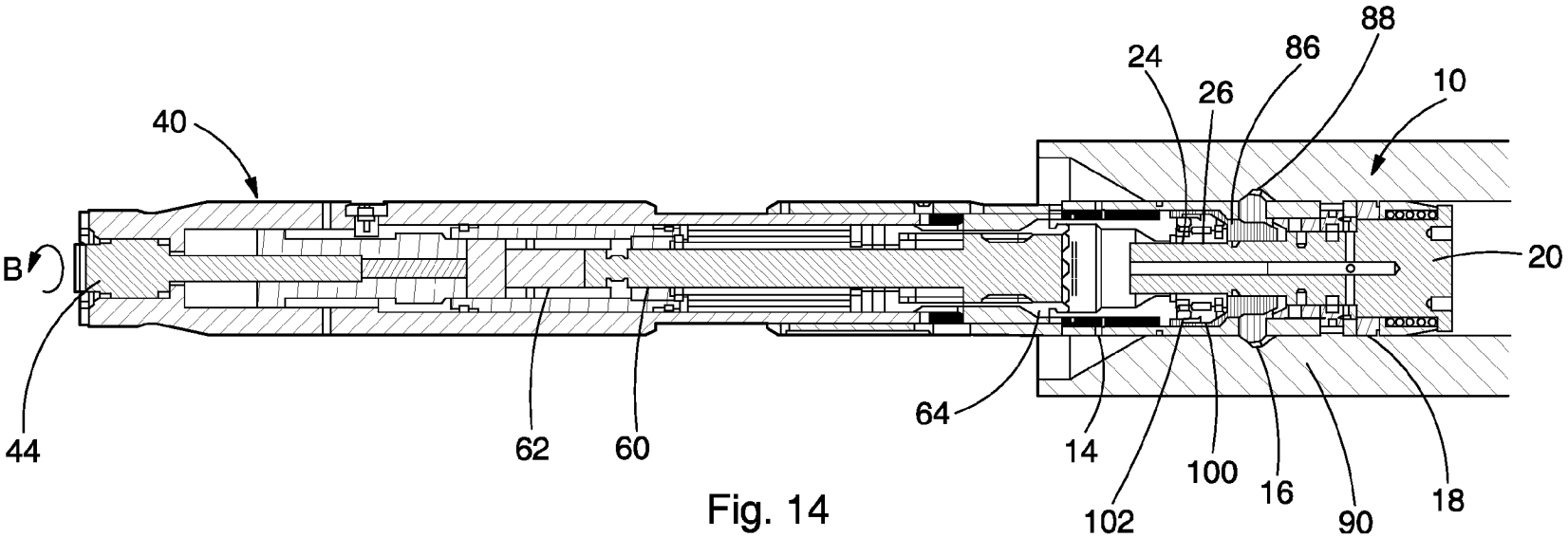
FIG. 14 is a longitudinal section view of the plug and tool of FIG. 1*a* showing the preferred method of retrieving the plug from the tree.

Referring now to FIG. 14, a longitudinal section view of the plug 10 and tool 40 of FIG. 1*a* showing the preferred method of retrieving the plug 10 from the tree 90 and FIG. 15 an enlarged cut-away side view of part of the tool mandrel 60, the collar 62 and the pins 56*a*,56*b* of FIG. 14, it may be necessary to retrieve the plug 10 from the tree 90 because, for example, the pressure test has shown the plug 10 is not adequately sealing the tree 90, or it is decided to remove the plug 10 from the tree 90 after the plug 10 has been in situ in the tree 90 for a period of time. In this case, the drive shaft 44 is rotated in the direction of arrow B without the application of a pulling force. When the drive shaft 44 is rotated in the direction of arrow B without the application of a pulling force, the pins 56*a*,56*b* travel from the position shown in FIG. 13*a* to the opposite ends 61 of the mandrel slot 58 the position shown in FIG. 15.

At this position the pins 56*a*,56*b* apply the rotational force in the direction of arrow B to the tool mandrel 60 and the gripping collar 62. This rotation is transferred through the collet fingers 64 to the setting sleeve 14. The interaction between the split nut thread 24 and the plug mandrel thread 26 results in the plug mandrel 20 moving axially away from the setting sleeve 14, disengaging the seal elements 18 from the tree 90.

Once the plug mandrel 20 has reached the extent of its travel, continued rotation of the setting sleeve 14 results in the setting sleeve 14 moving away from the dogs 16. As the setting sleeve 14 moves, a setting sleeve profile 100 engages a dog setting collar profile 102 resulting in axial movement of the dog setting collar 86 away from the dogs 16 permitting the dogs 16 to disengage from the tree recesses 88. Once the dogs 16 and the seal element 18 are disengaged from the tree 90, the tool 40 and the plug 10 can be recovered to surface.

Figure 16:
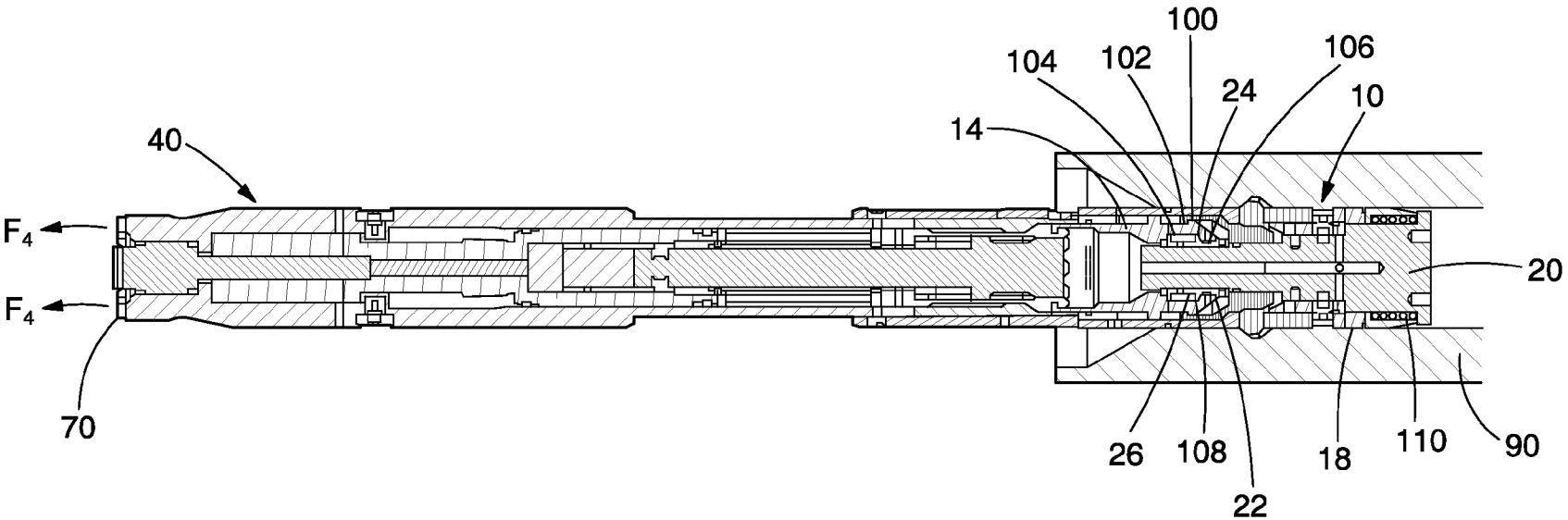
FIG. 16 is a longitudinal section view of the plug and tool of FIG. 1*a* showing an emergency method of retrieving the plug and tool to surface.

If the preferred method of retrieving the plug 10 described in FIGS. 14 and 15 does not work because, for example, the plug mandrel 20 is jammed, then an emergency release method of retrieving the tool 40 and the plug 10 to surface can be implemented. This will be described with reference to FIG. 16, a longitudinal section view of the plug 10 and tool 40 of FIG. 1*a*, showing an emergency method of retrieving a plug 10 and tool 40 to surface.

This emergency method is implemented by applying a pulling force $F_4$ of approximately 5,000 lbs to the end 70 of the tool 40. This force is sufficient to shear the pins 104,106 connecting the setting sleeve 14 to the split nut 22. Once the pins 104,106 have sheared, and under the action of the pulling force, the setting sleeve 14 translates axially with respect to the split nut 22 until the split nut 22 is located in a cavity 108 defined by an internal surface of the setting sleeve 14. Once located in the cavity 108, the split nut can separate, disengaging the split nut thread 24 from the plug mandrel thread 26. The setting sleeve 14 is then disengaged from the plug mandrel 20 and the plug mandrel 20 moves axially away from, releasing the compression force applied to the seal element 18 under the action of the mandrel spring 110. Continued application of the pulling force $F_4$ to the setting sleeve 14 engages the setting sleeve profile 100 with the dog setting collar profile 102 with the result that the dogs 16 disengage from the tree 90 permitting the tool 40 and plug 10 to be recovered to surface.

The final scenario is one in which the application of the 5,000 lb force is not sufficient to release the plug 10 from the tree 90 and, in this case, application of a greater force $F_5$ can be used to release the tool 40 from the plug 10 so that the tool 40 can be recovered to surface and an alternative tool, for example a drill, can be sent down to the tree 90 to remove the plug 10.

Figure 17:
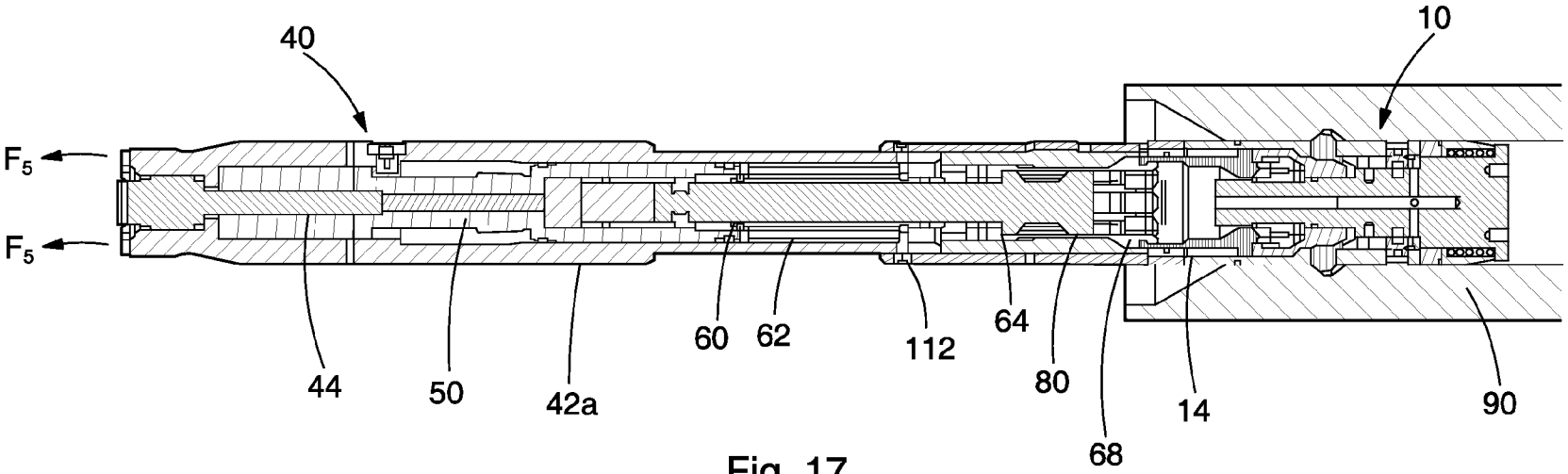
FIG. 17 is a longitudinal section view of the plug and tool of FIG. 1*a* showing the tool being retrieved from the plug in an emergency situation.

This scenario will be described in connection with FIG. 17, a longitudinal section view of the plug 10 and tool 40 of FIG. 1*a* showing the tool 40 being retrieved from the plug 10 in an emergency situation. In this situation the pulling force of 5,000 lbs is not sufficient to release the plug 10 from the tree 90. As the pulling force increases, it reaches the threshold force $F_5$ of the gripping collar shear pins 112 which connect the gripping collar 62 to the collet fingers 64. These pins 112 shear at a force of between 20,000 and 30,000 lbs. When the pins 112 shear, as shown in FIG. 17, the upper tool housing 42*a*, the drive shaft 44, the pulling sleeve 50, the tool mandrel 60 and the gripping collar 62 all translate axially away from the plug 10, with a result that the collet fingers 64, which are still engaged with the plug setting sleeve 14 are unsupported by the mandrel surface 80 permitting the collet finger tips 68 to deflect radially inwards under the action of the pulling force $F_5$, releasing the tool 40 from the plug 10. The tool 40 can then be retrieved to surface.

Figure 18:
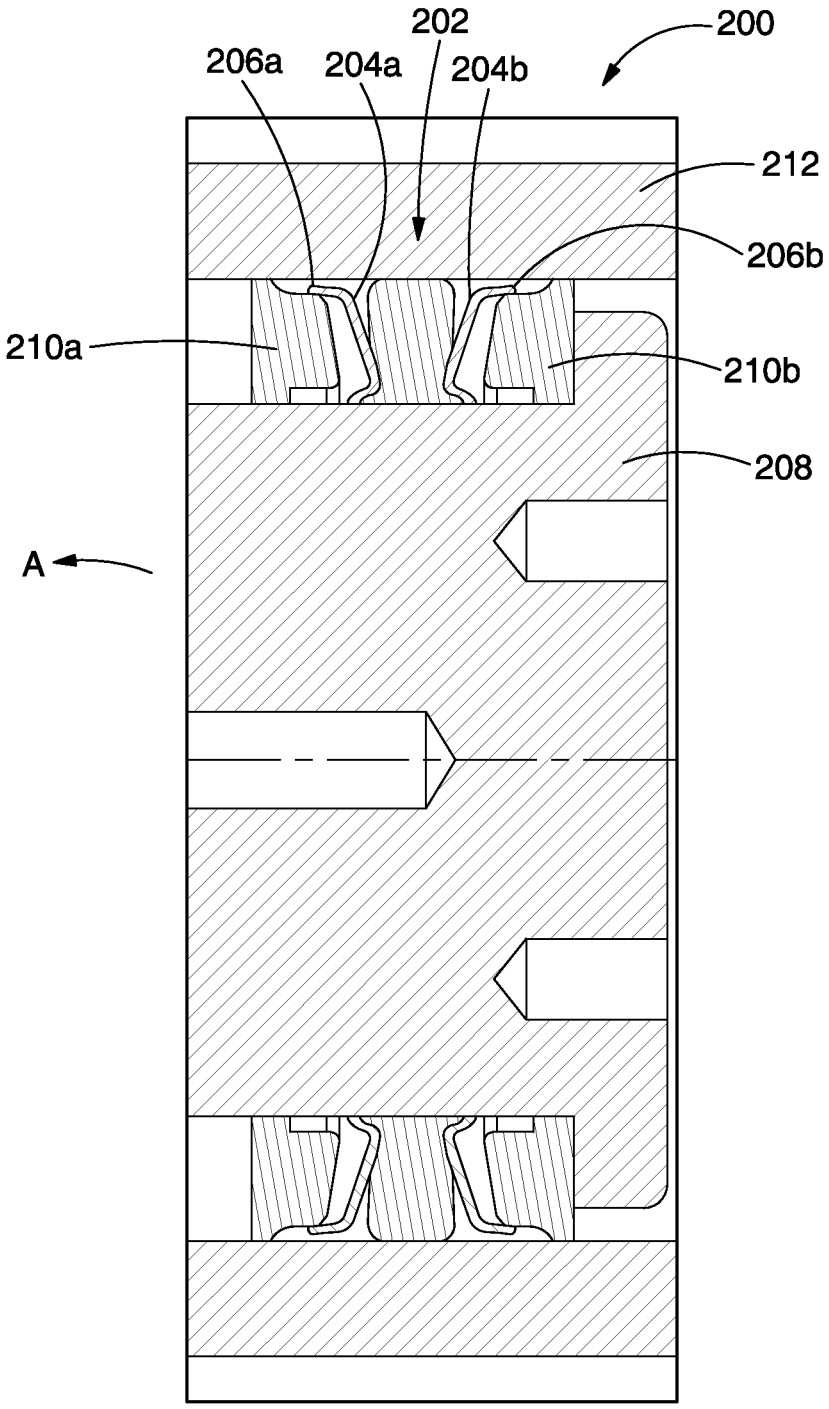
FIG. 18 is a longitudinal section view of part of a plug in a running configuration according to a second embodiment of the present invention.
Figure 19:
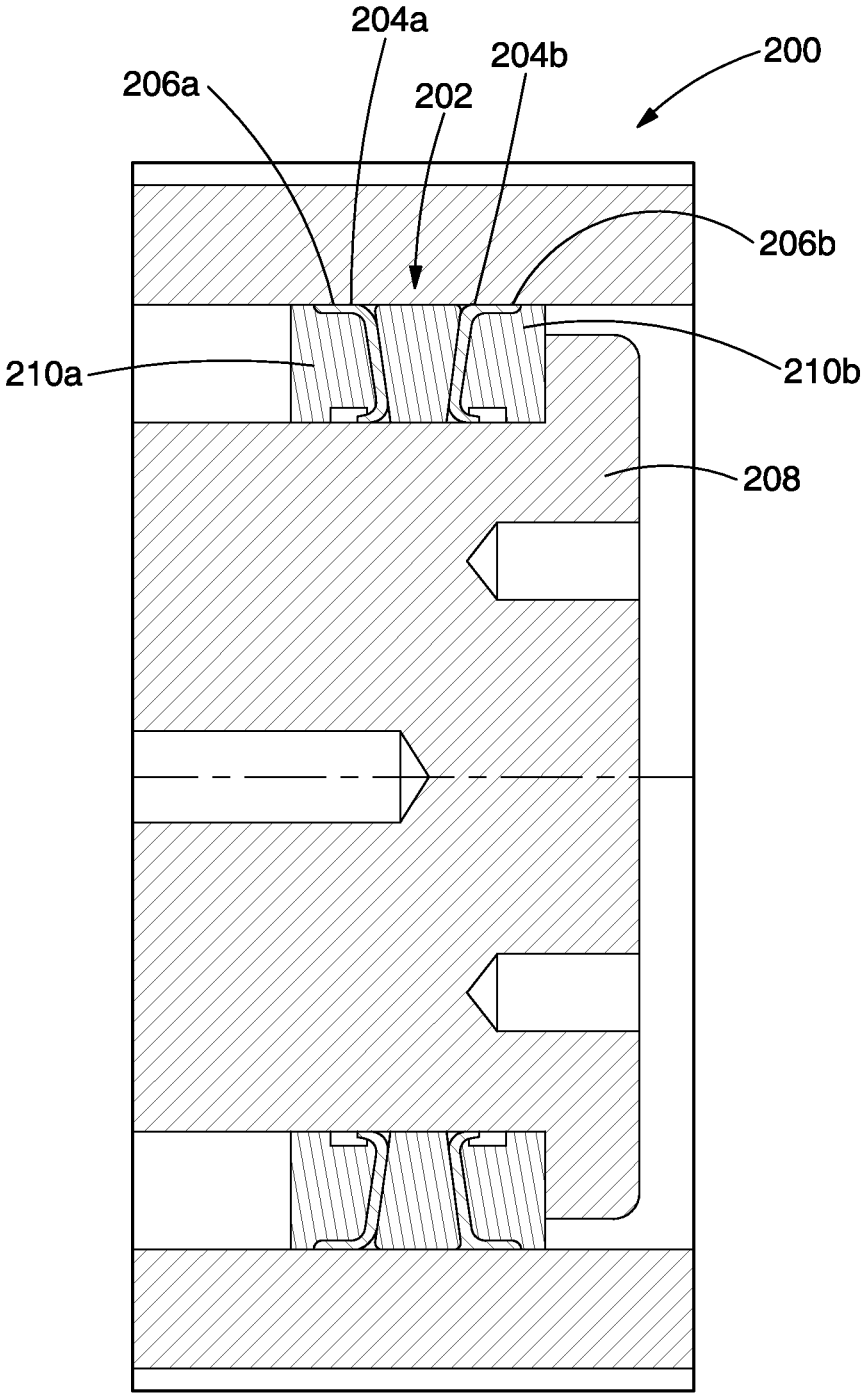
FIG. 19 is a longitudinal section view of the part of the plug of FIG. 18 in a set configuration.

Reference is now made to FIG. 18, a longitudinal section view of part of the plug 200 according to a second embodiment of the present invention. The main difference between the plug 200 of the second embodiment and the plug 10 of the first embodiment is the seal arrangement 202. The seal arrangement 202 comprises a pair of seal elements 204 in the form of frusto-conical washers 204*a*, 204*b* which face in opposite directions. Each washer 204 comprises an axially extending lip 206*a*, 206*b*. To set the plug 200, the mandrel 208 is pulled in the direction of arrow "A" forcing the seal wedges 210*a*,210*b* into engagement with the seal elements 204, forcing the seal elements 204 into engagement with the tree 212. This set configuration is shown in FIG. 19. Providing the lip 206 on each frusto-conical seal element 204, provides an arrangement in which less stress is induced.

Various modifications and improvements may be made to the embodiments hereinbefore described without departing from the scope of the invention. For example, it will be understood that any suitable form of seal element may be used or slips may be used instead of the dogs described. Furthermore, multiple metal seals could be used or, alternatively, a combination of metal and plastic seals where seal bore damage prevents an all metal seal arrangement from testing.

The invention claimed is:

1. A plug for sealing a conduit, the plug comprising:
a housing;
a setting member;
at least one anchor;
at least one seal element; and
a seal activation member,
wherein rotation of the setting member with respect to the housing in a setting direction causes axial movement of the setting member with respect to the housing to set the at least one anchor and axial movement of the seal activation member towards the setting member to set the at least one seal element and wherein rotation of the setting member with respect to the housing in a release direction opposite the setting direction releases the at least one anchor and the at least one seal element.

2. The plug of claim 1, wherein the setting member and the seal activation member are coupled together.

3. The plug of claim 2, wherein the setting member and the seal activation member are releasably coupled together.

4. The plug of claim 2, wherein the setting member and the seal activation member are coupled through a threaded connection.

5. The plug of claim 4, wherein the threaded connection comprises a first threaded portion defined by the setting member and the second threaded portion defined by the seal activation member.

6. The plug of claim 5, wherein the threaded connection is arranged such that friction between the first threaded portion and the second threaded portion prevents the setting member rotating with respect to the seal activation member in the release direction.

7. The plug of claim 5, wherein the threaded connection is arranged such that a mechanical locking arrangement between the first threaded portion and the second threaded portion prevents the setting member rotating with respect to the seal activation member in the release direction.

8. The plug of claim 5, wherein the setting member threaded portion is defined by a nut releasably connected to the setting member sleeve.

9. The plug of claim 8, wherein the setting member nut is a split nut.

10. The plug of claim 8, wherein when the setting member sleeve moves with respect to the setting member nut, the setting member releases from the seal activation member.

11. The plug of claim 10, wherein the plug is arranged such that the split nut is contained by the sleeve, and movement of the sleeve with respect to the nut permits the nut to separate and release from the seal activation member threaded section.

12. The plug of claim 11, wherein when the setting member releases from the seal activation member a force is applied to the seal activation member to release the at least one seal element.

13. The plug of claim 1, wherein rotation of the setting member with respect to the seal activation member in the setting direction sets the at least one anchor and the at least one seal element.

14. The plug of claim 1, wherein rotation of the setting member with respect to the housing in the release direction requires an external force to be applied to the setting member.

15. The plug of claim 1, wherein the seal activation member is prevented from rotational movement.

16. The plug of claim 15, wherein the seal activation member is rotationally restrained to the housing.

17. The plug of claim 1, wherein the setting member comprises a sleeve.

18. The plug of claim 1, wherein the seal activation member comprises a mandrel.

19. The plug of claim 1, wherein in use, the at least one anchor is set prior to the at least one seal element.

20. The plug of claim 1, further comprising a setting tool.

21. The plug of claim 20, wherein the setting member is adapted to be connected to the setting tool.

22. The plug of claim 21, wherein the setting tool is adapted to apply a rotational force to the setting member to rotate the setting member in the setting direction.

23. The plug of claim 21, wherein the setting tool is adapted to apply a rotational force to the setting member to rotate the setting member in the release direction.

24. The plug of claim 1, wherein initial rotation of the setting member in the setting direction causes axial movement of the setting member with respect to the housing and the seal activation member.

25. The plug of claim 1, wherein once the at least one anchor is set, further axial movement of the setting member with respect to the housing and the seal activation member is prevented.

26. The plug of claim 1, wherein once the at least one anchor is set, further rotation of the setting member with respect to the housing causes axial movement of the seal activation member with respect to the housing and the setting member.

27. The plug of claim 1, wherein axial movement of the seal activation member with respect to the housing and the setting member is adapted to set the at least one seal element.

28. The plug of claim 1, wherein the at least one seal element is set by compression.

29. The plug of claim 28, wherein the at least one seal element is compressed by being squeezed between the setting member and the housing.

30. The plug of claim 28, wherein the at least one seal element is compressed by being squeezed between the seal activation member and the housing.

31. The plug of claim 1, wherein the at least one seal element comprises at least one metal seal element.

32. The plug of claim 1, wherein the at least one seal element comprises at least one frusto-conical washer.

33. The plug of claim 32, wherein the at least one seal element comprises a plurality of frusto-conical washers.

34. The plug of claim 33, wherein there are two frusto-conical washers.

35. The plug of claim 34, wherein the frusto-conical washers face in opposite directions.

36. The plug of claim 32, wherein the at least one frusto-conical washer comprises a lip adapted to engage with a well bore.

37. The plug of claim 36, wherein the lip extends axially for an outer edge of the washer.

38. The plug of claim 37, wherein the at least one anchor comprises a plurality of dogs.

39. The plug of claim 1, wherein the at least one anchor comprises at least one dog.

40. The plug of claim 1, wherein the plug is adapted to be retrieved by applying a releasing force to the plug.

41. The plug of claim 40, wherein the plug is adapted, in use, to disengage from a tree when the releasing force exceeds a threshold value.

42. The plug of claim 1, wherein the at least one anchor and the at least one seal element are set by rotation about a longitudinal axis of the plug.

43. A tool for setting the plug of claim 1.

44. A tool for retrieving the plug of claim 1.

45. The plug of claim 1, wherein the rotation of the setting member in the release direction causes axial movement of the setting member with respect to the housing to release the at least one anchor and causes axial movement of the seal activation member away from the setting member to release the at least one seal element.

46. A tool for setting a plug in a conduit, the tool comprising a plug engaging device wherein rotation of the plug engaging device in a setting direction causes axial movement of a setting member relative to a housing to set at least one anchor and causes axial movement of a seal activation member towards the setting member to set at least one seal element and thereby set the plug in a conduit and wherein rotation of the plug engaging device in a release direction opposite the setting direction releases the plug from the conduit.

47. The tool of claim 46, wherein the tool is adapted to transmit a pulling force to a plug.

48. The tool of claim 46, wherein the tool is adapted to transmit a pushing force to a plug.

49. The tool of claim 46, wherein the tool is adapted to retrieve the plug.

50. The tool of claim 46, wherein the tool further comprises a tool mandrel, the tool mandrel adapted to selectively maintain the plug engaging device with a plug.

51. The tool of claim 50, wherein the tool mandrel is movable with respect to the plug engaging device to permit radial movement of the plug engaging device.

52. The tool of claim 50, wherein the tool mandrel is rotationally movable with respect to the plug engaging device.

53. The tool of claim 50, wherein the tool mandrel is both rotationally and axially movable with respect to the plug engaging device.

54. The tool of claim 46, wherein radial movement of the plug engaging device disengages, in use, the plug engaging device from a plug.

55. The tool of claim 46, wherein linear movement of the plug engaging device disengages, in use, the plug engaging device from a plug.

56. The tool of claim 46, wherein the tool is arranged such that the plug engaging device, in use, only disengages from the plug if the plug is correctly set.

57. The tool of claim 46, wherein the plug engaging device comprises a plurality of collet fingers.

58. The tool of claim 46, wherein the rotation of the setting member in the release direction causes axial movement of the setting member with respect to the housing to release the at least one anchor and causes axial movement of the seal activation member away from the setting member to release the at least one seal element.

59. A plug and setting tool system, the system comprising:

a plug, the plug comprising a housing, a setting member, at least one anchor at least one seal element and a seal activation member; and a tool, the tool comprising a setting member engaging device;

wherein rotation of the setting member engaging device in a setting direction rotates the setting member with respect to the housing, rotation of said setting member causing axial movement of the setting member with respect to the housing to set the at least one anchor and axial movement of the seal activation member towards the setting member to set the at least one seal element and wherein rotation of the setting member engaging device in a release direction opposite the setting direction releases the at least one anchor and the at least one seal element.

60. The system of claim 59, wherein the rotation of the setting member in the release direction causes axial movement of the setting member with respect to the housing to release the at least one anchor and causes axial movement of the seal activation member away from the setting member to release the at least one seal element.

61. A method of setting and unsetting a plug in a conduit, the method comprising the steps of:

rotating a plug setting member in a setting direction, said rotation causing axial movement of the setting member relative to a housing to set at least one anchor; and continuing to rotate the plug setting member in the setting direction, said rotation causing axial movement of the setting member towards the setting member to set at least one seal element;

rotating the plug setting member in a release direction opposite the setting direction to release the at least one seal element;

continuing to rotate the plug setting member in the release direction to release the at least one anchor; and wherein said rotating the plug setting member in a release direction opposite the setting direction causes axial movement of the setting member with respect to the housing to release the at least one seal element; and said continuing to rotate the plug setting member in the release direction causes axial movement of the seal activation member away from the setting member to release the at least one anchor.

62. The method of claim 61, the method further comprising the step of applying a pulling force to the plug to retrieve the plug from the conduit.

* * * * *